US011259642B2

(12) United States Patent
Engemann et al.

(10) Patent No.: US 11,259,642 B2
(45) Date of Patent: Mar. 1, 2022

(54) SYSTEM FOR SECURING A BED COVERING TO A BED

(71) Applicant: NEATERBED COMPANY LLC, Warren, NJ (US)

(72) Inventors: Karen Engemann, Berkeley Heights, NJ (US); Laura Hardman, Berkeley Heights, NJ (US)

(73) Assignee: NEATERBED COMPANY LLC, Warren, NJ (US)

( * ) Notice: Subject to any disclaimer, the term of this patent is extended or adjusted under 35 U.S.C. 154(b) by 278 days.

(21) Appl. No.: 16/130,464

(22) Filed: Sep. 13, 2018

(65) Prior Publication Data

US 2020/0085200 A1 Mar. 19, 2020

(51) Int. Cl.
*A47C 21/02* (2006.01)

(52) U.S. Cl.
CPC ..... *A47C 21/022* (2013.01)

(58) Field of Classification Search
CPC ..... A47C 21/022; A47C 21/02; A47C 21/028; A47C 21/024; A47G 9/04; Y10T 24/23
See application file for complete search history.

(56) References Cited

U.S. PATENT DOCUMENTS 2,188,576 A * 1/1940 Mulloy ..... A47C 21/022 5/498
2,223,412 A * 12/1940 Gartz ..... A47C 21/022 24/72.5
2,459,497 A * 1/1949 Calabro ..... A47C 21/022 24/72.5
2,507,091 A * 5/1950 Carlson ..... A47C 21/022 24/72.5
2,537,652 A * 1/1951 Churchill ..... A47C 27/005 5/499
2,729,831 A 1/1956 Fuld et al.
3,832,743 A 9/1974 Smith
4,040,133 A 8/1977 Gilreath
4,488,323 A 12/1984 Colburn
4,662,016 A * 5/1987 Seeman ..... A47C 21/022 24/72.5
4,884,305 A 12/1989 Blackmon
5,092,010 A 3/1992 Wong
5,327,595 A * 7/1994 Allen ..... A47C 21/022 24/72.5
5,946,751 A 9/1999 Demay
(Continued)

FOREIGN PATENT DOCUMENTS

GB 2549476 A * 10/2017 ..... A47G 9/04
WO WO-2014064346 A1 * 5/2014 ..... A47C 21/022

*Primary Examiner* — Robert G Santos
*Assistant Examiner* — Alison N Labarge
(74) *Attorney, Agent, or Firm* — Stephen J. Weyer, Esq.; Stites & Harbison, PLLC

(57) ABSTRACT

A system, including a device and method, for securing a covering, such as a coverlet, quilt, duvet or comforter to a bed, and a kit and method for applying the system to an existing bed and covering. A sleeve encircles the mattress and includes an engagement structure on its lower surface. The covering includes a tab which fits beneath the mattress and its support structure and further includes a second engagement structure which faces upwardly to engage the engagement structure on the sleeve. A kit includes just a sleeve and a tab with a structure for engagement to a covering.

11 Claims, 8 Drawing Sheets

(56) References Cited

U.S. PATENT DOCUMENTS

| | | | | |
|---|---|---|---|---|
| 6,149,234 | A | 11/2000 | Daniels | |
| 8,566,983 | B2 | 10/2013 | Monaco | |
| 2017/0055735 | A1* | 3/2017 | Kazoglou | A47C 21/022 |
| 2017/0164767 | A1* | 6/2017 | Serafini | A47G 9/02 |

* cited by examiner

FIG. 13
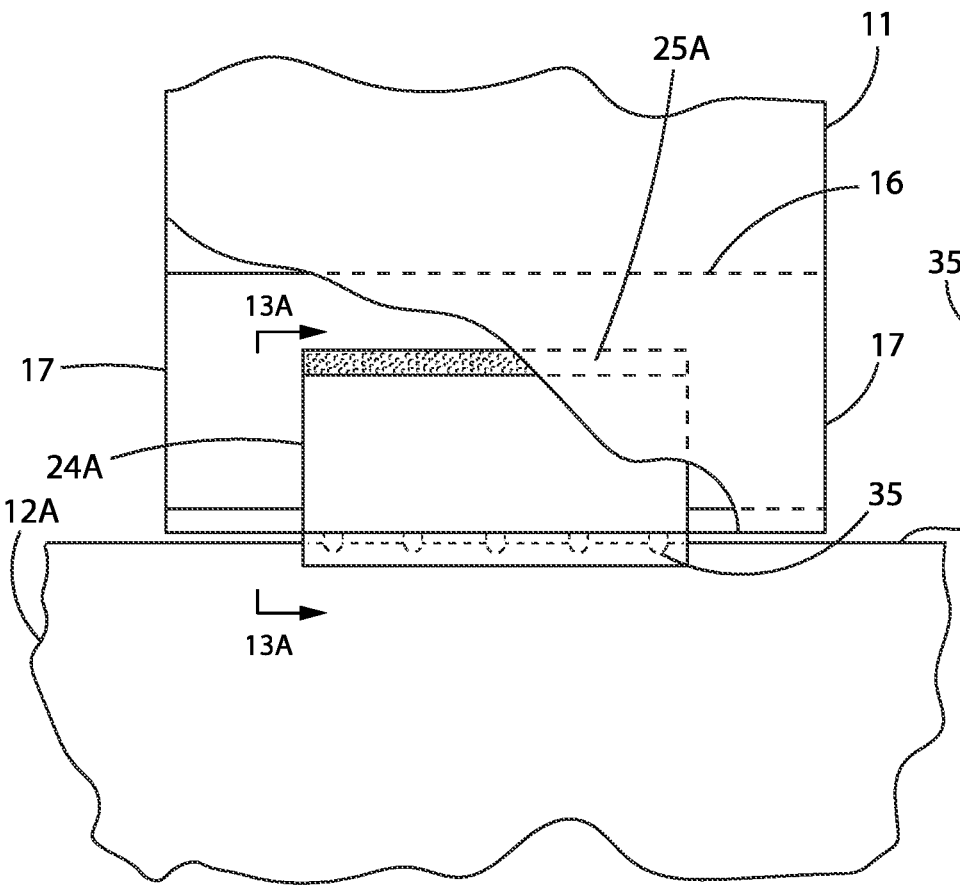
FIG. 13A
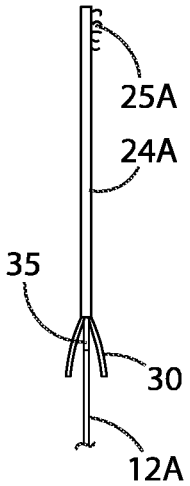
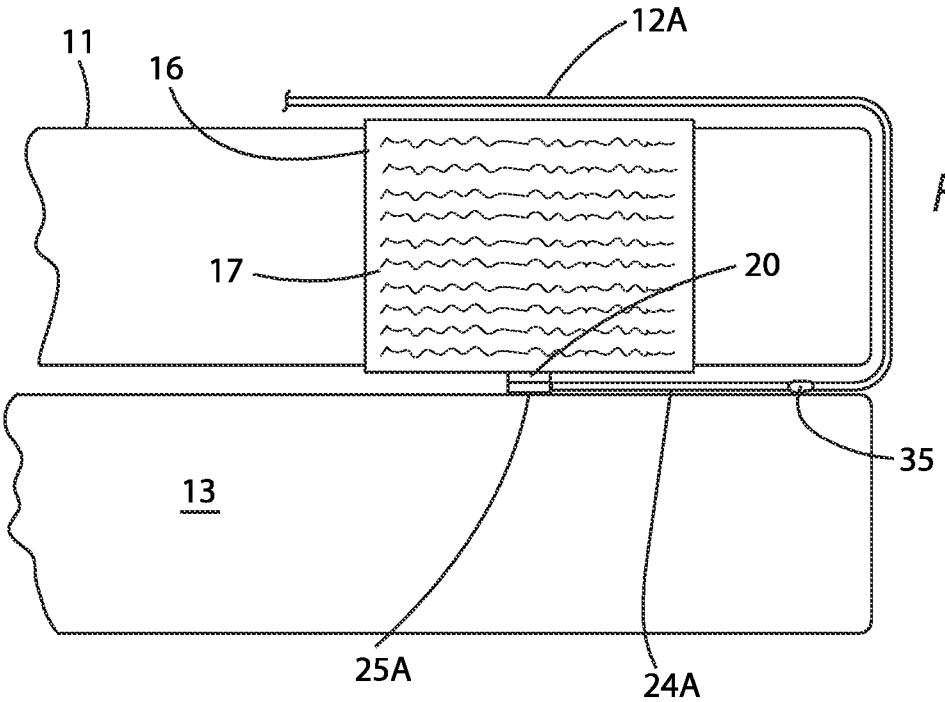
FIG. 14

SYSTEM FOR SECURING A BED COVERING TO A BED

FIELD OF THE INVENTION

The system of the present invention involves a method and a device for securing a bed covering such as a coverlet, quilt, comforter or duvet onto the top of a bed.

BACKGROUND OF THE INVENTION

The term "bed covering" is used herein to encompass coverings over the top of a bed such as a coverlet, quilt, duvet or comforter. Problems associated with such bed coverings include the fact that they move off the bed during the night and the difficulty in making up the bed, especially if it is important that the bed have a neat look.

These problems are especially of concern for a hotel, wherein the usual bed covering is a coverlet, quilt, duvet or comforter which are technically different from each other, but all have in common that they are more bulky than a blanket and are used as the top bed covering in a hotel. For convenience, the term "comforter" will be used herein generically to include a coverlet, quilt, duvet or comforter.

The trend today in bedding, especially for a hotel, is a simple, clean, neater look with the comforter tucked underneath the mattress on a support structure which may be a platform or a box spring, thus forming a mattress/platform combination or a mattress/box spring combination. It is also helpful for the system to address the ability to quickly and neatly make the bed with minimal effort and to keep the bedding off of the floor after a night's sleep.

SUMMARY OF THE INVENTION

The system of the present invention overcomes the above-described problems and achieves the advantageous results discussed above.

In accordance with the system of the present invention, a mattress sleeve entirely encircles the mattress toward the bottom thereof. The sleeve is a band of non-stretchable, preferably woven fabric on the top and the bottom and has expandable elastic fabric on each side to accommodate various mattress thicknesses.

On the outside of the bottom of the sleeve, facing the box spring or platform beneath the mattress, a first engagement structure, which might be a strip of Velcro, is attached to the sleeve with its engaging surface facing downwardly toward the box spring or platform.

A comforter, viewed with its lower surface facing upwardly and its bottom edge adjacent the bottom of the bed has a tab extending outwardly from the bottom of the comforter into the space between the mattress and support structure and a second engagement structure which may be a Velcro strip with its engaging surface facing upwardly to engage the Velcro strip attached to the bottom of the sleeve.

The bottom of the mattress is then lifted just enough that the tab of the comforter and its Velcro strip can be slid between the mattress and the support structure, i.e., the box spring or platform, until the two engaging surfaces, such as the two Velcro strips, engage each other, at which time the mattress is released and the two engagement structures engage and, together with the weight of the mattress, hold the tab in place.

The entire tab plus possibly part of the comforter is preferably located between the mattress and the support structure so that the tab will not be visible.

After the above manipulations, the comforter, which would most likely be off the bottom of the bed and facing upwardly, is simply flipped over onto the top of the bed; and because of its attachment, it will be quick and easy to spread the comforter over the bed with a clean, neat look.

It will also be noted that with this arrangement the sleeve, tab and engagement structures do not interfere with the sheets, whether fitted or flat.

According to a variation of the present invention, key parts of the system can comprise a kit which can be used to modify an existing bed to include the features and advantages of the present invention. The kit would comprise a sleeve identical to the sleeve as described above plus a tab which would be similar to the tab described above in that it would have a Velcro strip on its upper surface which would engage the Velcro strip of the sleeve, but the tab would not be attached to a comforter. Instead, at its edge which would have been attached to the comforter, it would have a structure for attachment to the bottom end of any comforter, which attachment structure might include clips. With this arrangement one could place the sleeve onto the mattress of an existing bed and then attach the clips at the bottom of the tab to the bottom edge of any comforter.

Advantages of the present invention will become more apparent from the figures and the detailed description of the invention which follow.

BRIEF DESCRIPTION OF THE DRAWINGS

The present invention will be more clearly understood by reference to the detailed description to follow, taken together with the accompanying drawings, wherein:

FIGS. 12, 13 and 14 illustrate a variation of the system of the present invention for applying same to an existing bed covering and mattress.

FIG. 12 is a top plan view of a sleeve for a mattress, a tab, and a comforter, respectively, with these parts separated from each other.

FIG. 13 is a top plan view similar to FIG. 12 but with the tab and comforter connected and attached to the sleeve.

FIG. 13A is a side view taken along line 13A-13A of FIG. 13.

FIG. 14 is a side elevational view of FIG. 13.

DETAILED DESCRIPTION OF THE PREFERRED EMBODIMENTS

Referring to the figures, like elements are represented by like numerals throughout the several views.

Figure 1:
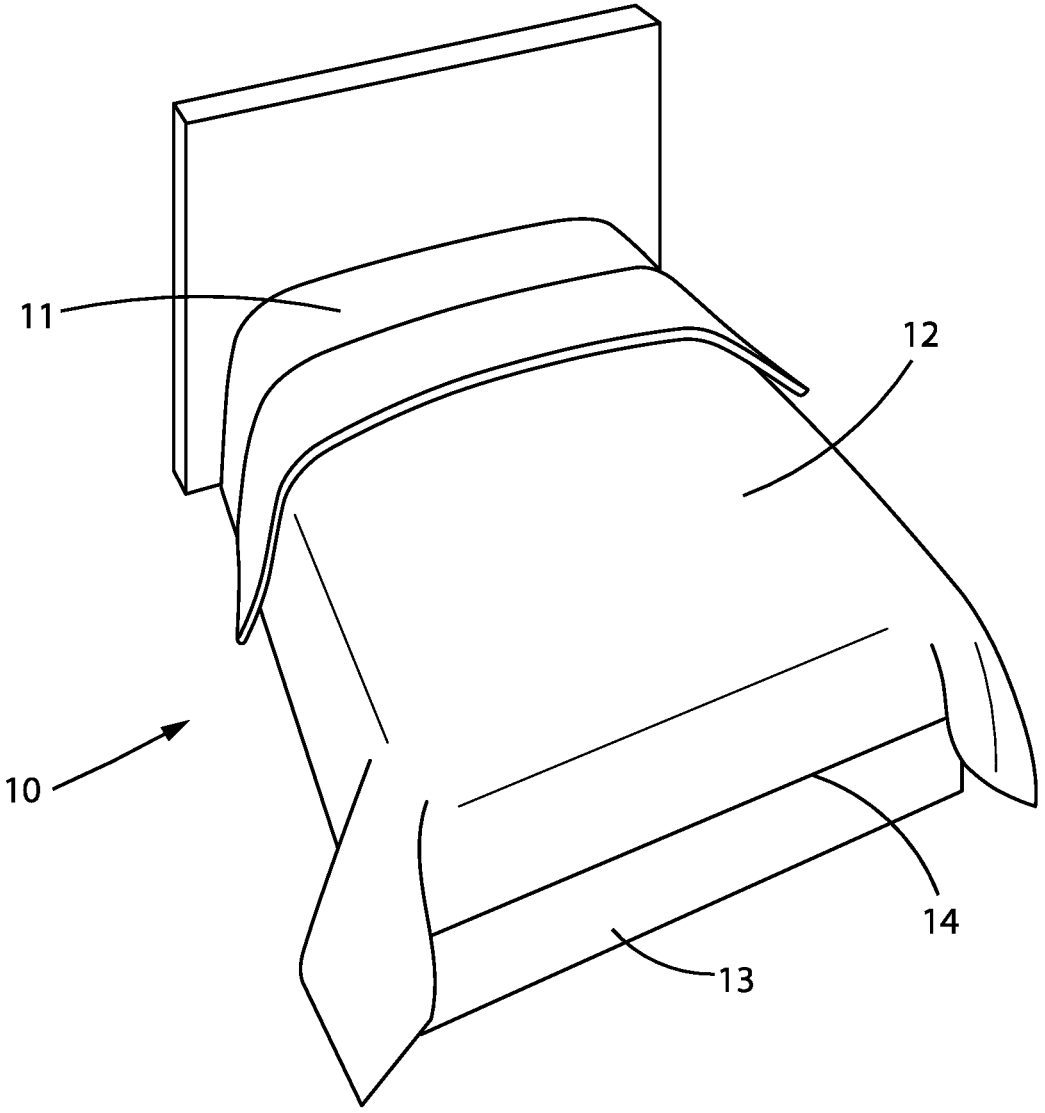
FIG. 1 is a perspective view of a made up bed with a comforter thereon using the system of the present invention.

FIG. 1 illustrates a made bed 10 including a mattress 11 with a comforter 12 thereon, the mattress being secured to a support structure 13. The comforter 12 goes over the side and bottom of the mattress.

FIG. 1 illustrates the desirable presentation of a bed and comforter comprising a simple, clean, neat look.

Figure 2:
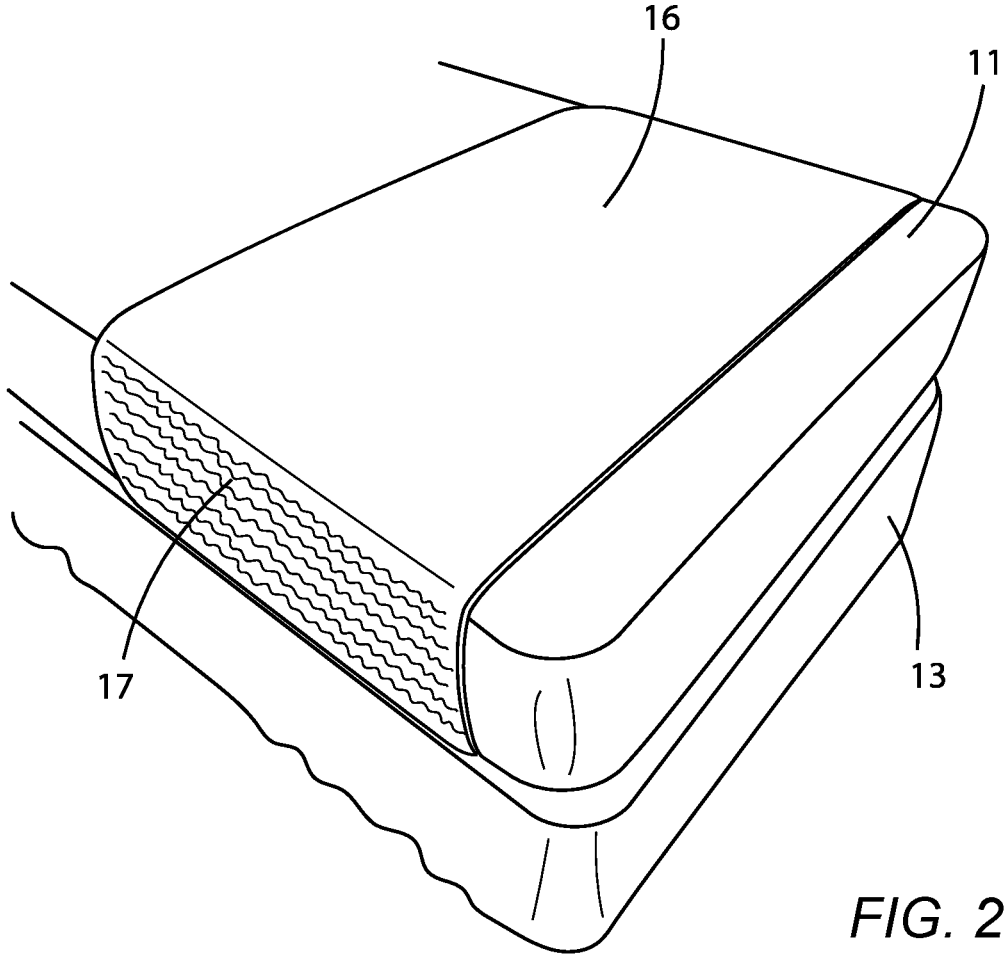
FIG. 2 is an enlarged perspective view of a mattress on a support structure showing a sleeve of the present invention.

FIG. 2 shows the mattress 11 on the support structure 13 with a sleeve 16 encircling the mattress. The sleeve can be of any suitable dimension along the length of the bed and is preferably placed near the bottom of the bed. The sleeve may be made of a uniform woven, non-stretchable upper and lower fabric with a stretchable fabric on the sides 17 so as to accommodate mattresses of different thicknesses. Mattresses generally have a thickness between 8 inches and 16 inches. At any thickness within this range, the fabric of sides 17 would have enough stretch to secure the sleeve to the mattress.

Figure 3:
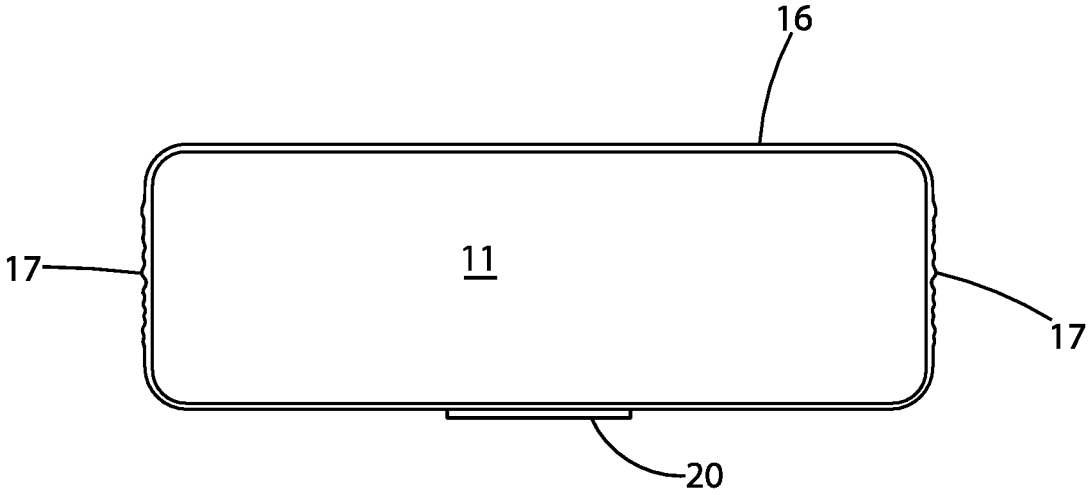
FIG. 3 is an end view of the mattress of FIG. 2.

FIG. 3 is an end view showing the mattress 11 with the sleeve 16 encircling it and the stretchable fabric 17 on the sides. Also shown in FIG. 3 is an end view of an engagement structure 20 which is attached to the bottom of the sleeve.

Figure 4:
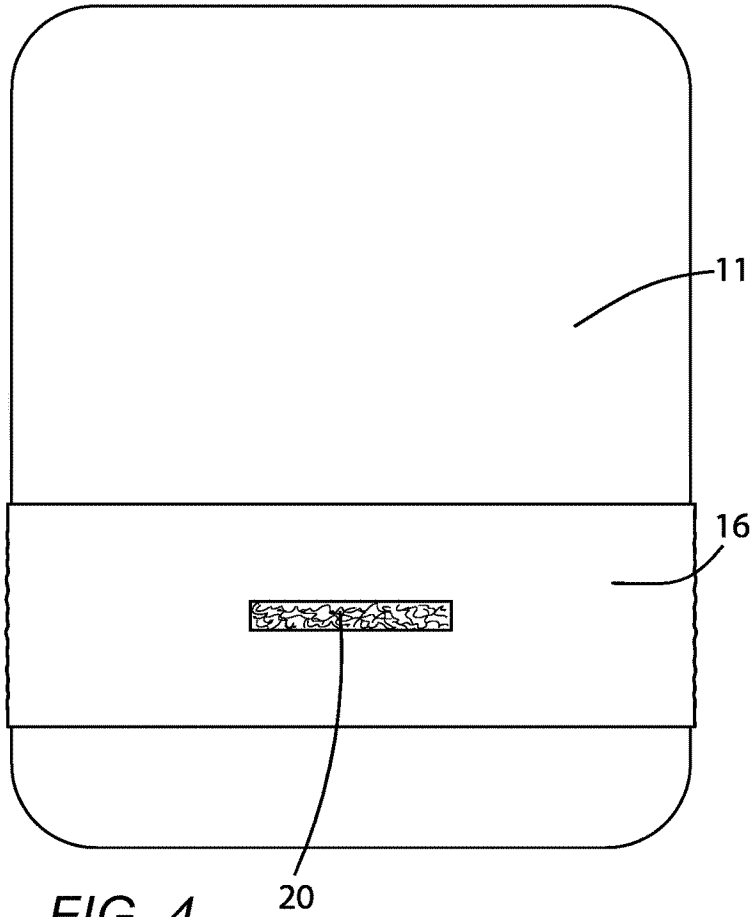
FIG. 4 is a bottom view of a mattress and sleeve.

FIG. 4 is a plan view of the bottom of the mattress showing the sleeve 16, attached to which is a first engagement structure 20 which in the present embodiment is a Velcro strip. Engagement structures other than Velcro can also be used.

Figure 5:
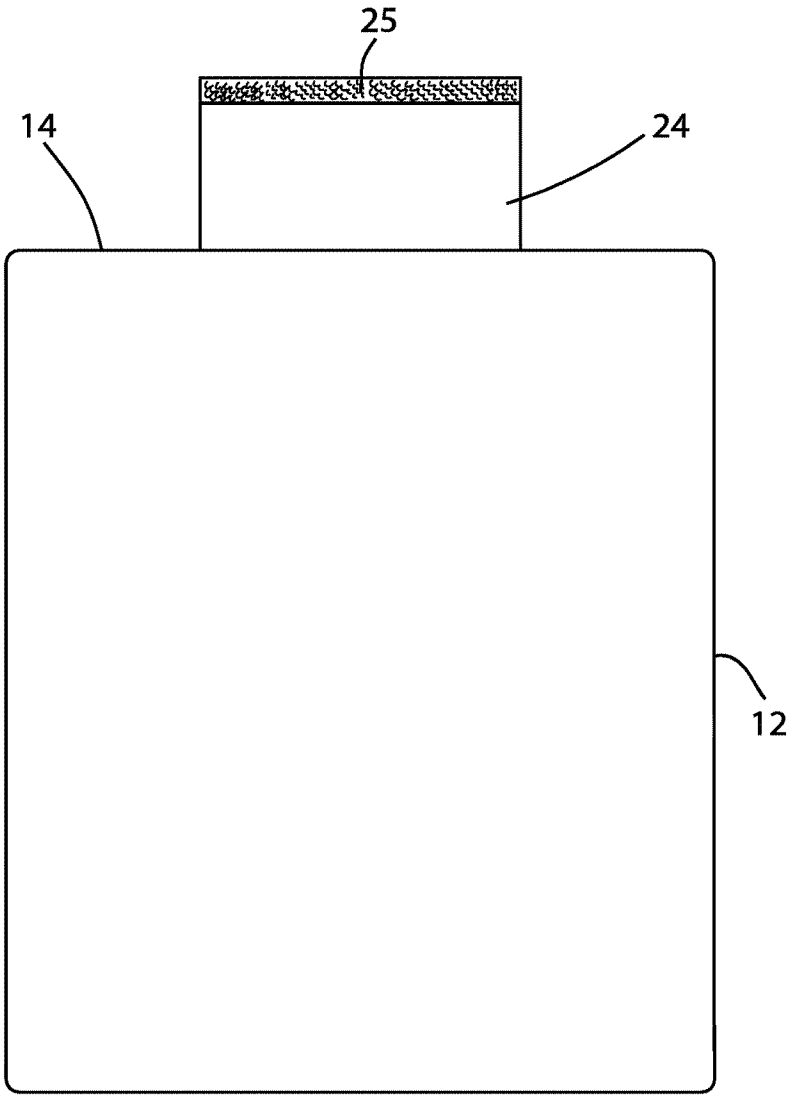
FIG. 5 is a top view of a comforter wherein the lower surface faces upwardly.

FIG. 5 is a top view of the underside of the comforter 12. A tab 24 extends outwardly from the bottom end 14 of the comforter and has a second engagement structure 25, in the present embodiment, also a Velcro strip, although as in the case of the first engagement structure, can comprise other engagement structures.

The Velcro strip 25 would preferably be located at the outer end of the tab 24 such that in use it would line up directly below the Velcro strip 20 of the sleeve 16.

Figure 6:
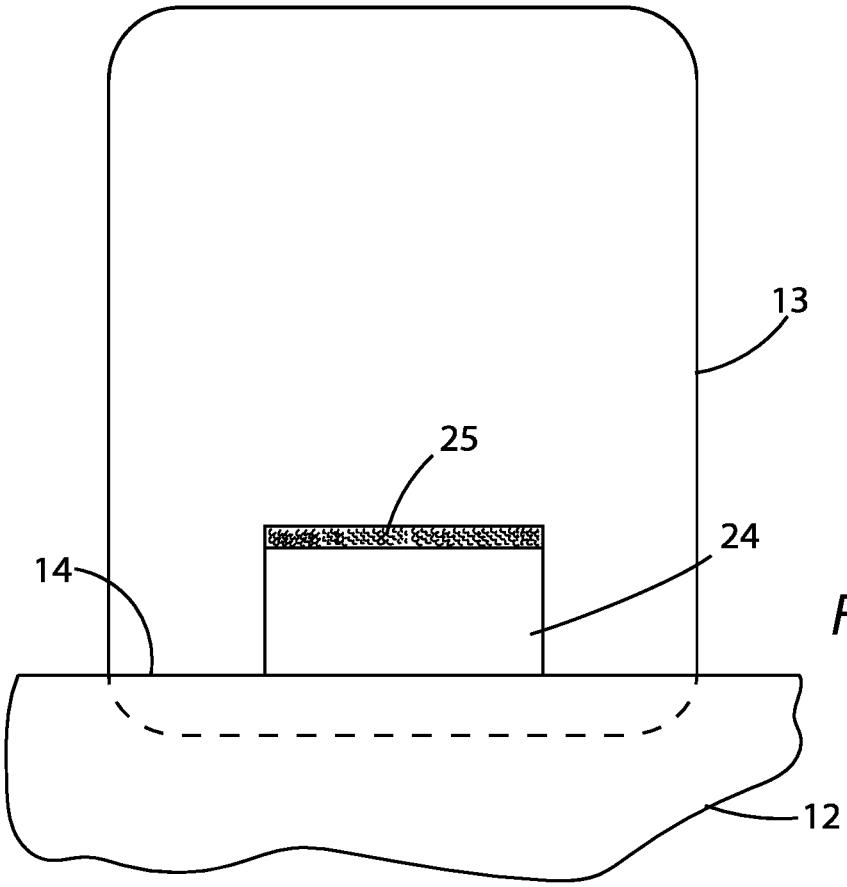
FIG. 6 is a top view of a support structure and a top view of the lower surface of the comforter and showing a first step in a method of the present invention.
Figure 7:
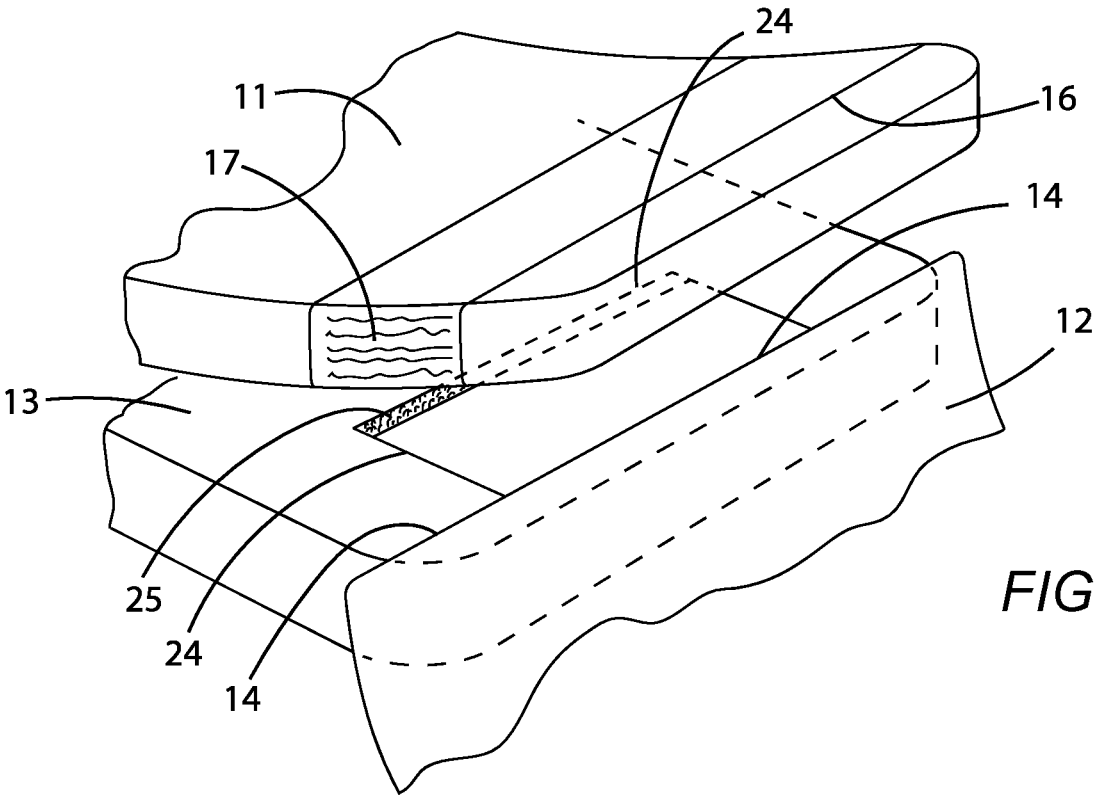
FIG. 7 is a perspective side view at a corner of a mattress and a support structure, showing a second step in a method of the present invention.

FIGS. 6 and 7 illustrate the initial steps in a method of securing the comforter to the mattress. FIG. 6 illustrates the tab 24 positioned on the support structure 13. The end 14 of the comforter 12 to each side of the tab 24 is preferably located in the space between the mattress and support structure so that when the comforter is flipped up and over the bed, no portion of the tab 24 will be visible.

FIG. 7 illustrates how, during the initial securing steps, the mattress is lifted so that the tab 24 can be inserted between the mattress and the support structure. At this point, the Velcro strip 25 at the end of tab 24 would lie directly beneath the Velcro strip 20 on the sleeve 16. Thereafter, the mattress will be lowered so that the Velcro strips 20 and 25 engage. This engagement of these engagement structures, along with the weight of the mattress on the tab 24 of the comforter 12 will securely hold the comforter in place relative to the mattress 11 and the support structure 13.

Figure 8:
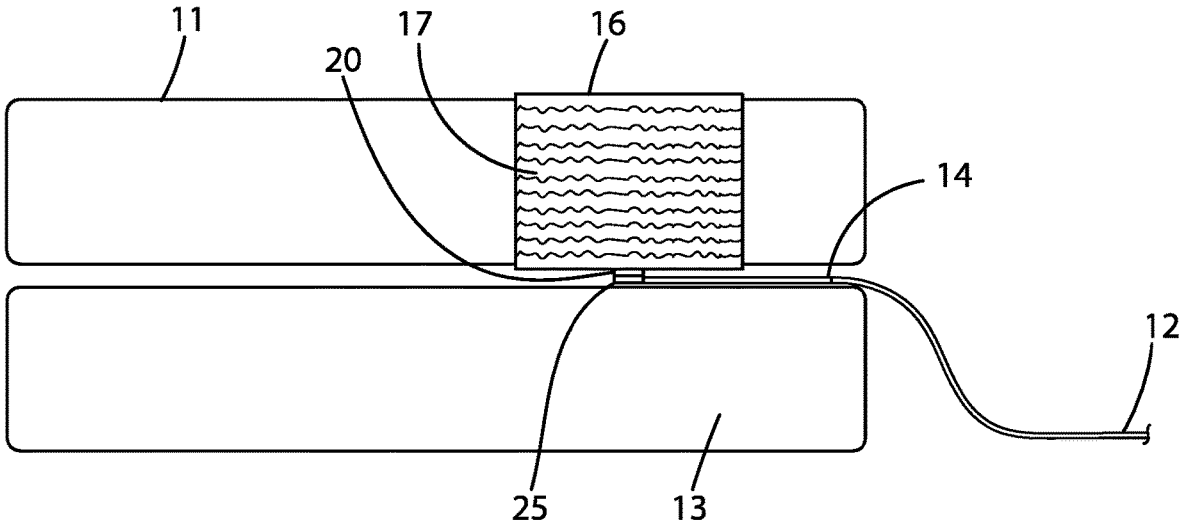
FIG. 8 is a side elevational view of a comforter and a mattress after completion of the steps shown in FIGS. 6 and 7.

FIG. 8 is a side view showing the position of the comforter just after the steps of FIGS. 6 and 7.

Figure 9:
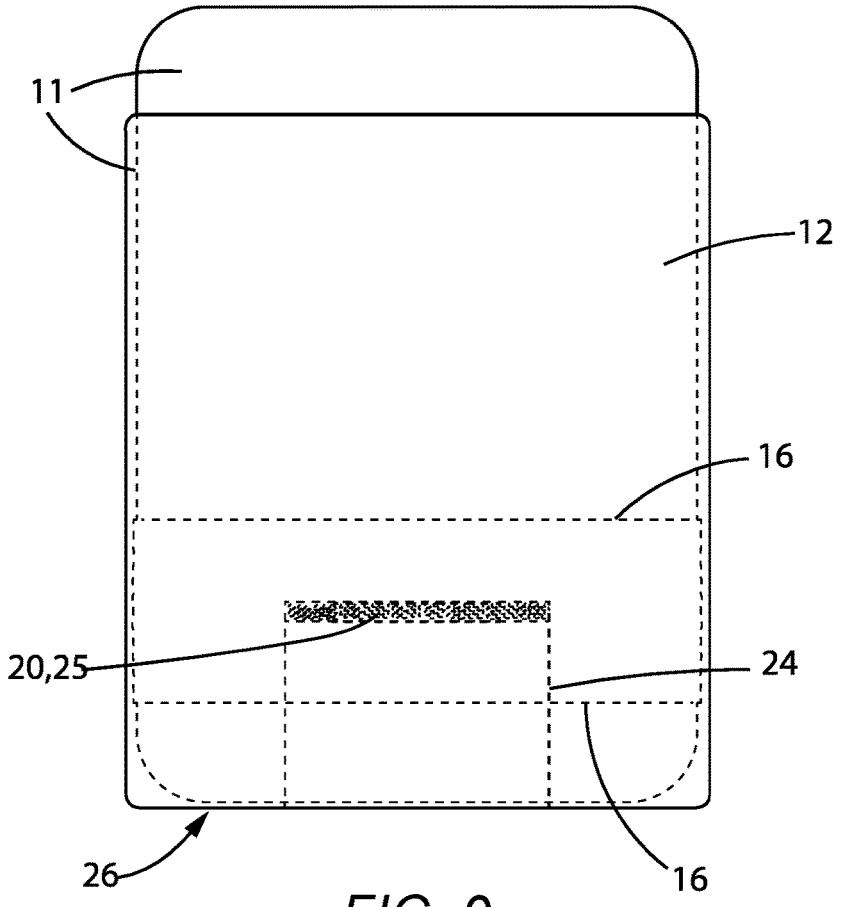
FIG. 9 is a top plan view of the bed after the comforter has been moved onto the top of the bed.
Figure 10:
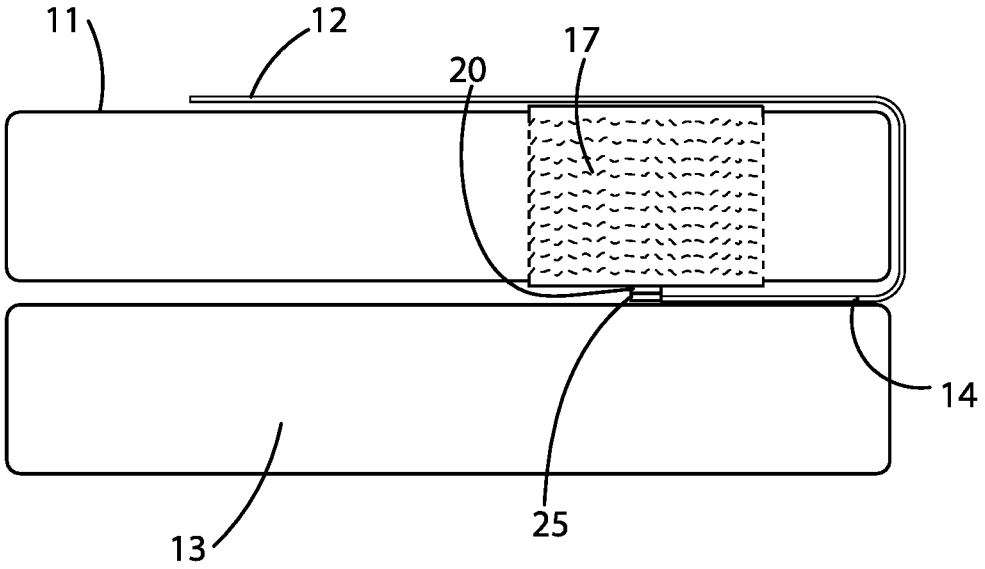
FIG. 10 is a side elevational view of FIG. 9.

FIGS. 9 and 10 show, in plan view and side elevation view, respectively, the final position of the bed and comforter after the comforter has been moved from its position as shown in FIG. 8 up and over the top of the bed.

Figure 11:
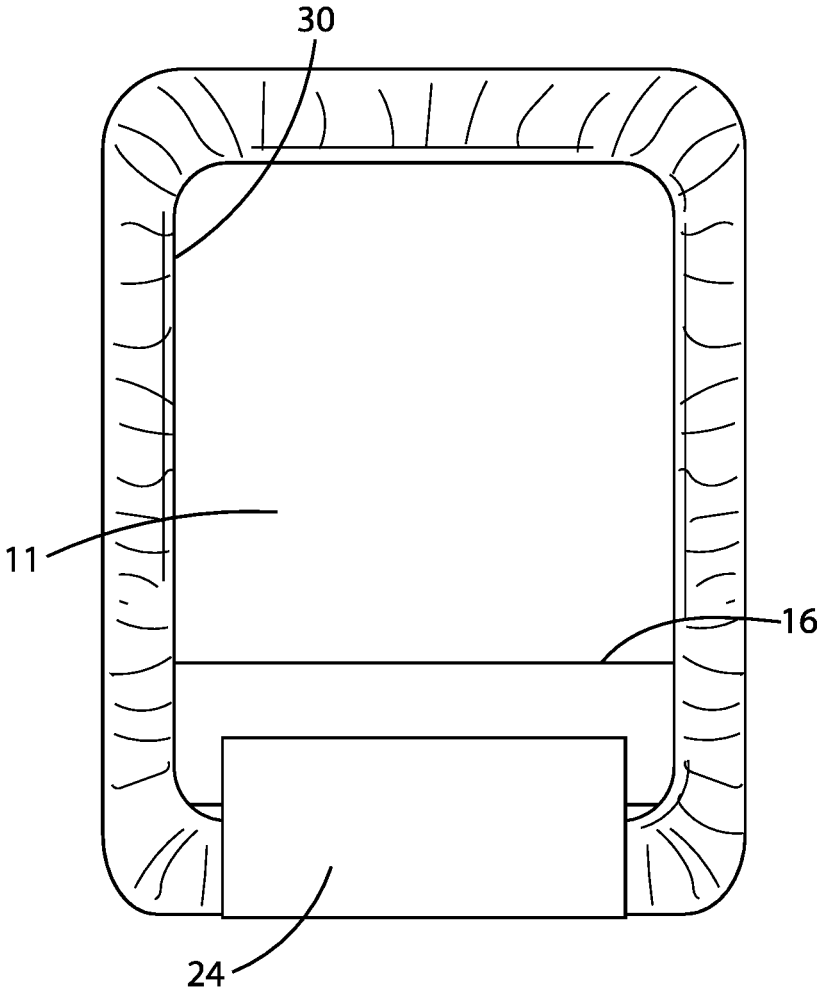
FIG. 11 is a bottom view of a mattress including a fitted sheet with the comforter attached to the sleeve of the mattress.

It is an advantage of the present invention that the system of securing the comforter to the mattress does not interfere with the sheets, whether fitted or flat. This is because, as shown in FIG. 11, the engagement structures are located on the interior of the bottom of the mattress at a location where they do not interfere with the bed sheets.

Although it will be apparent that the dimensions of the various parts of the invention can vary for specific circumstances, the following dimensions have been found to be suitable. The sleeve would have a dimension along the length of the bed of 22 inches and the height on the sides would vary from a minimal height of 8 inches for a mattress of that thickness to a height of 16 inches for a mattress of that thickness. At 8 inches, the elastic sides 17 would still have a sufficient grip to secure the sleeve 16 to the mattress. The Velcro strip would be placed centrally along the bottom of the sleeve, having, for all size mattresses, a width in the top to bottom direction of the bed of 2 inches. For a twin mattress having a width of 38 inches the strip would be 26 inches across. For a full mattress with a width of 54 inches, the Velcro strip would have a length of 42 inches across. For a queen mattress having a width of 60 inches, the Velcro strip would have a length of 48 inches across. For a king size mattress having a width of 76 inches, the Velcro strip would have a length of 64 inches across.

With respect to the comforter, the tab 24 would extend outwardly from its end 14 for 14 inches and the Velcro strip would extend across the tab at the outer end thereof and have a width of 2 inches. For a twin bed, the tab would have a width of 26 inches. For a full sized bed, the tab would have a width of 42 inches. For a queen bed, the tab would have a width of 48 inches. And for a king sized bed, the tab would have a width of 64 inches.

According to a variation, the advantages of the present invention can be utilized to modify an existing mattress and comforter to include the advantageous features of the present invention.

Specifically, certain key parts of the invention, referred to herein as a "kit", is all that is needed to convert a conventional mattress/comforter into one to include the features of the present invention. This variation is described in FIGS. 12-14 wherein elements which correspond to the same elements in FIGS. 1-11 are shown with the subscript A.

Figure 12:
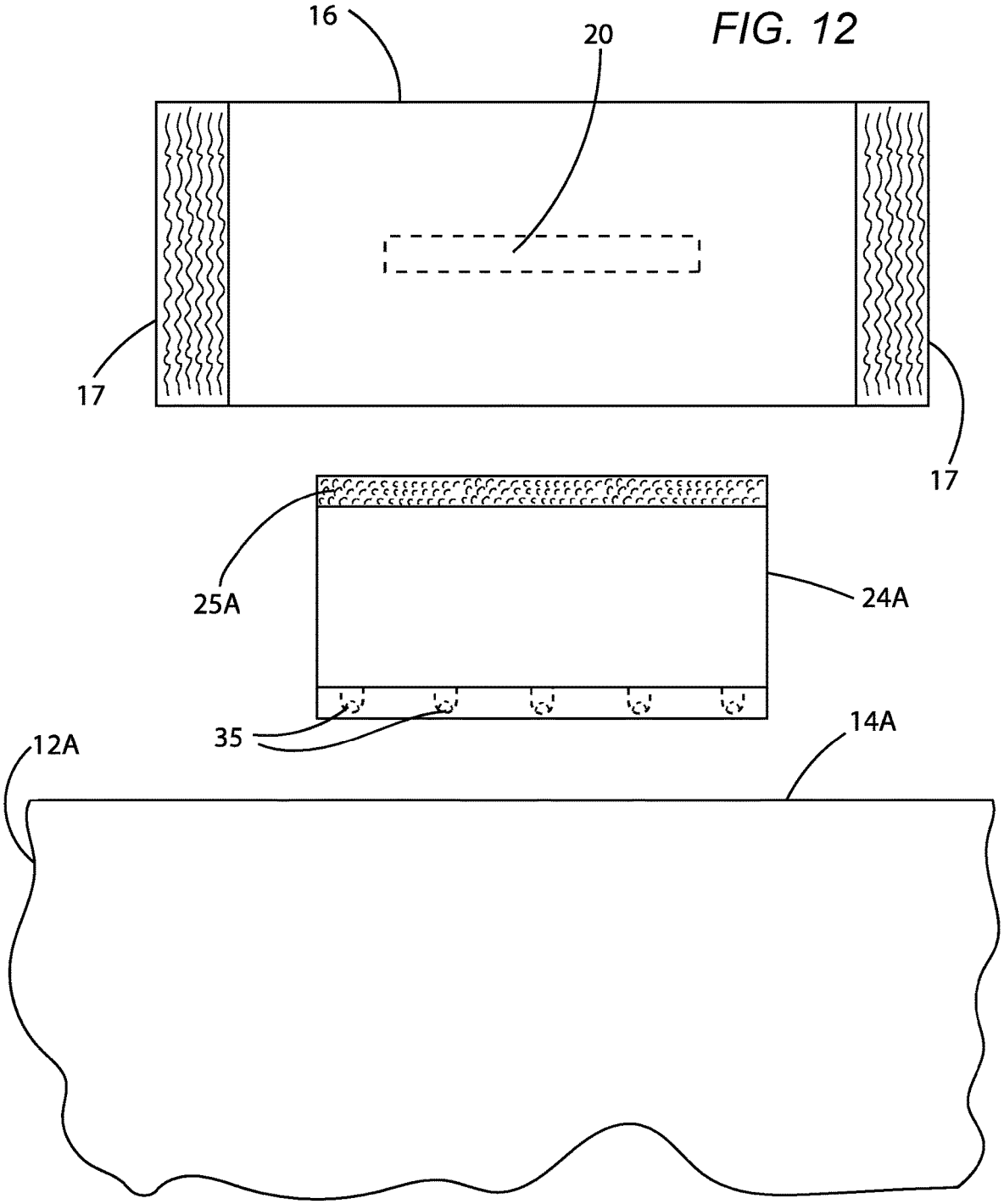

Referring to FIG. 12, the kit would include a sleeve 16 identical to the sleeve 16 in FIGS. 1-11, including a stretchable fabric on the sides 17, and a hook/loop strip such Velcro strip 20. In FIG. 12 the sleeve is shown from above, and flat, so that the top half of the sides 17 are shown in the plane of the figure.

The second element of the kit would include a modified tab 24A (planar sheet) which, instead of being attached to a comforter would be separate from any comforter and include clips 35 for attachment to the edge 14A of a conventional comforter. The tab 24A includes an open bottom which normally hides the clips 35 from view, but wherein the clips are accessible through the open bottom.

FIG. 13 is a plan view of the sleeve 16, mounted on a mattress 11 with the sleeve and mattress partially cut away to show the tab 24A and a complementary hook/loop strip (Velcro strip 25A) to Velcro strip 20, which would be aligned with Velcro strip 20 of the sleeve, to form a substantial planar and secure engagement between sleeve 16 and tab 24A (planer sheet). At its end facing the comforter, clips 35 attach the tab 24A to the end 14A of the comforter 12A which is shown in FIG. 13 with its bottom surface facing upwardly. The two ends of the tab 24A include a slit opening 30 at their lower ends to allow the two sides of tab 24A to extend over the end of the comforter 12 to cover the clips 35.

FIG. 14 illustrates the final stage in making the bed using the kit, wherein the comforter 12 is flipped up over the top of the bed in the same manner as shown in FIGS. 9 and 10.

Similar to what is described with respect to FIGS. 1-11, the juncture of the tab 24A and the comforter 12A, namely the clips 35, is preferably located between the mattress and the support structure, or at least not outside of the juncture of these two so that no part of the tab 24A or the clips 35 are visible.

The present invention further includes a method of converting a conventional mattress/comforter to have the advantages of the present invention. Initially, a kit is provided which includes a sleeve similar to that described in FIGS. 1-11 in addition to a tab which has the general shape of the tab provided in FIGS. 1-11 but wherein it is provided separately from any comforter and includes an attachment structure such as clips along its lower edge for being attached to a conventional comforter with the bottom surface of the comforter facing upwardly and with its bottom 14A adjacent to and grasped by the engagement structure, i.e., clips 35, of the tab.

Thereafter, making of the bed is completed as described in FIGS. 1-11 by flipping the comforter up and over the top of the bed after traditional beddings, including flat or fitted sheets, blankets, etc., have been applied.

As will be understood from the preceding discussion, the system of the present invention provides the above-described advantages in that the bed can be made quickly (after the sheets and other blankets have been applied) by simply grasping the comforter and pulling it up and over the top of the bed. Because of the secure connection between the comforter and the mattress, it will be a relatively simple task to present a clean, neat look with the comforter tucked beneath the mattress with the tab out of sight. Additionally, the present invention will tend to avoid the comforter coming off of the bed as the occupant turns and otherwise moves the comforter during the night; and in the morning the comforter will most likely have been maintained on the bed and off the floor.

Although the invention has been described with respect to a preferred embodiment, it is to be understood that the invention is capable of numerous modifications and variations, apparent to those skilled in the art, without departing from the spirit and scope of the invention.

The invention claimed is:

1. A system for securing a covering to a bed, said system comprising:
- a tubular sleeve configured to encircle a mattress, the tubular sleeve having a lower surface facing downwardly;
- a planar sheet attachable to the lower surface of the tubular sleeve to thereby form a substantial planar and secure engagement with the tubular sleeve, the planar sheet having an open bottom; and
- at least one clip for joining the planar sheet to a bed mattress covering,
- wherein the open bottom of the planar sheet hides the at least clip from view but wherein the at least one clip is accessible through the open bottom.

2. The system according to claim 1, wherein the planar and secure engagement comprises complementary hook and loop strips.

3. The system according to claim 1, wherein the tubular sleeve comprises a non-stretchable portion and a stretchable portion.

4. The system of claim 3, wherein:
- the non-stretchable portion comprises two non-stretchable portions, a first non-stretchable upper portion and a second non-stretchable lower portion, and
- the stretchable portion comprises a first stretchable portion and a second stretchable portion,
- wherein the first non-stretchable upper portion and the second non-stretchable lower portion are connected together on opposing sides via the first stretchable portion and the second stretchable portion, respectively.

5. The system of claim 1, wherein the planar sheet is attached to the lower surface of the tubular sleeve.

6. A method of modifying a conventional bed covering for a: mattress, said method comprising:
- encircling a mattress of a bed with a tubular sleeve having on a lower surface an engagement structure with its engaging surface facing downwardly;
- attaching a planar sheet to the engagement structure to form a substantially planar and secure engagement between the planar sheet and the tubular sleeve, the planar sheet having an open bottom; and
- attaching at least one clip to secure the planar sheet to the bed covering,
- wherein the open bottom of the planar sheet hides the at least clip from view but wherein the at least one clip is accessible through the open bottom.

7. The method according to claim 6, wherein the substantially planar and secure engagement comprises complementary hook and loop strips.

8. The method according to claim 6, wherein the tubular sleeve comprises a non-stretchable portion and a stretchable portion.

9. The method according to claim 8, wherein:
- the non-stretchable portion comprises two non-stretchable portions, a first non-stretchable upper portion and a second non-stretchable lower portion, and
- the stretchable portion comprises a first stretchable portion and a second stretchable portion,
- wherein the first non-stretchable upper portion and the second non-stretchable lower portion are connected together on opposing sides via the first stretchable portion and the second stretchable portion, respectively.

10. A method of modifying a conventional bed covering for a mattress, said method comprising:
- encircling a mattress of a bed with a tubular sleeve having a lower surface, the tubular sleeve having a planar sheet attached to the lower surface via a substantially planar and secure engagement between the planar sheet and the tubular sleeve, the planar sheet having an open bottom; and
- attaching at least one clip to secure the planar sheet to the bed covering,
- wherein the open bottom of the planar sheet hides the at least clip from view but wherein the at least one clip is accessible through the open bottom.

11. The method according to claim 10, wherein:
- the tubular sleeve comprises a non-stretchable portion and a stretchable portion,
- the non-stretchable portion comprises two non-stretchable portions, a first non-stretchable upper portion and a second non-stretchable lower portion, and
- the stretchable portion comprises a first stretchable portion and a second stretchable portion,
- wherein the first non-stretchable upper portion and the second non-stretchable lower portion are connected together on opposing sides via the first stretchable portion and the second stretchable portion, respectively.

* * * * *